US005573486A

United States Patent [19]

Beliakov

[11] Patent Number: 5,573,486

[45] Date of Patent: Nov. 12, 1996

[54] SAFETY CONTROLS FOR MUSCLE DEVELOPMENT EXERCISE MACHINE

[76] Inventor: Evgeni Beliakov, 3412 Farthing Dr., Wheaton, Md. 20906

[21] Appl. No.: 377,105

[22] Filed: Jan. 23, 1995

[51] Int. Cl.[6] ..... A63B 23/00

[52] U.S. Cl. ..... 482/120; 482/1; 482/5; 482/4; 482/118; 482/903

[58] Field of Search ..... 482/1–8, 114–119, 482/903, 63, 120; 73/379.01–379.09

[56] References Cited

U.S. PATENT DOCUMENTS

| | | | |
|---|---|---|---|
| 4,537,396 | 8/1985 | Hooper | 482/8 |
| 4,678,184 | 7/1987 | Neiger et al. | 482/4 |
| 4,822,032 | 4/1989 | Whitmore et al. | 482/63 |
| 4,979,733 | 12/1990 | Prud'Hon | 482/4 |
| 5,176,599 | 1/1993 | Beliakov . | |

*Primary Examiner*—Richard J. Apley
*Assistant Examiner*—Glenn E. Richman
*Attorney, Agent, or Firm*—Laurence R. Brown

[57] ABSTRACT

It is critical to prevent muscular damage to an athlete in a machine that produces a restraining force that must be overcome in the initial part of an exercise stroke. This is achieved by a precise and accurate type of control system by which the athlete safely and surely control the initial restraining force magnitude. With a reliable vernier type control device the athlete then may "inch-by-inch" increase the restraining force as the muscles become able to overcome greater forces in the manner the proverbial strong man lifts a calf each day so that he can lift a full grown cow eventually. In a preferred embodiment of this vernier type control the restraining device comprises an electromagnet with a retained magnetic member coupled to the athlete by an intermediate muscular operated linkage. The vernier restraining force adjustment device is an electrical current control rheostat coupled in a current supply line for the electromagnet, that accordingly provides the athlete with a self controlled device permitting the athlete to tone muscular development in a safe and effective manner without the danger of physical muscle damage that is likely if the magnetic restraining force becomes too strong.

5 Claims, 3 Drawing Sheets

SAFETY CONTROLS FOR MUSCLE DEVELOPMENT EXERCISE MACHINE

TECHNICAL FIELD

This invention relates to muscle development exercise machines and more particularly it relates to those muscle development exercise machines that impede an initial portion of an athlete's exercise stroke with a restraining force.

BACKGROUND ART

A critical deficiency occurs in muscular development exercise machines of the prior art that impede an initial portion of an athlete's exercise stroke with a restraining force. This deficiency could lead to inadvertent serious damage to the athlete by strain or rupture of muscular tissue. The defect is that the restraining force magnitude could neither be accurately controlled, nor could it be controlled linearly over a vernier ranges of incremental adjustment that is critical in day-by-day exercise to improve muscular performance.

For example, in mechanical exercise machines of reasonable cost, it is difficult to hold tolerances close and precise. Even if this is done, after wear and subjection to impact forces that are involved in the subject exercise machines mechanical spacing adustments become unreliable in magnitude. Thus, even if an air gap is adjustable between a permanent magnet and magnetic member it the vicinity of the permanent magnet, a linear scale of vernier adjustment would not be feasible, since the magnetic forces are variable as the square of the distance between the magnetic members and known to be fixed distances cannot be established reliably.

Accordingly it is an objective of this invention to provide a safe, accurate vernier type control of the restraining force imposed upon the initial portion of an athlete's exercise stroke in an exercise machine.

DISCLOSURE OF THE INVENTION

This invention provides an electromagnet to produce the required restraining force for the exercise machine upon an electromagnetically attracted magnetic member. The electromagnet current is controlled by a rheostat, which may be designed for linear and vernier control over a working range of restraining forces by the athlete. This control means is not subject to deterioration over life of the machine, due in part to the direct contact between the electromagnet pole member and the magnetic member held thereby, and in part due to the precise control of force magnitude that may be effected with electromagnetic current.

Other objects, features and objectives of the invention will be found throughout the following specification, drawings and claims.

BRIEF DESCRIPTION OF THE DRAWINGS

In the drawings, wherein like reference characters identify similar features in the various views.

THE PREFERRED EMBODIMENT

Figure 1:
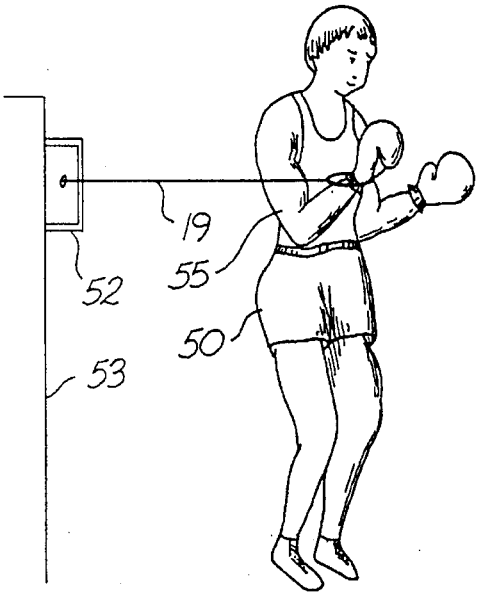
FIG. 1 is a sketch of a boxer ready to deliver a blow, who is coupled by a cord to the exercise machine afforded by this invention.
Figure 2:
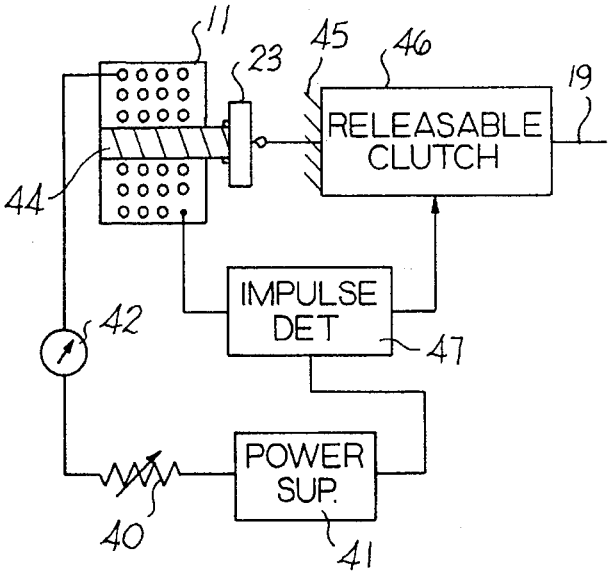
FIG. 2 is a schematic block diagram of the control system for adjusting the magnitude of restraining force exerted upon the athlete in accordance with this invention.

It is seen from FIGS. 1 and 2 that the boxer 50 has a cord 19, with a body wrist band attached to his right arm 55 at one end and with the other end coupled to the exercise machine 52, anchored to wall 53. This exercise machine 52 restrains movement of the athlete's arm 55 from its starting posture for an exercise stroke until the athlete exerts a force overcoming a predetermined externally induced threshold force determined by a control mechanism in the exercise machine 52. After the threshold force is overcome, all restraining forces are essentially removed so that the arm 55 may freely move in a normal punching stroke as the cord 19 is paid out. By practice on this exercise machine, with appropriate threshold forces selected by the particular athlete to gradually improve athletic prowess over a range of forces, the muscular strength of the athlete improves. Other muscles may be exerted as in the legs of a runner springing from starting blocks, or muscles in the body involved in a golf swing, etc.

It is critical to prevent muscular damage to an athlete in a machine that produces a restraining force that must be overcome in the initial part of an exercise stroke. If the threshold set on the machine becomes too high to overcome in a given state of body preparation, muscles may be strained or ruptured. This invention thus achieves accurate and precise control of the initial restraining force, over which the athlete has safe and sure personal control. Thus, a reliable and repeatable vernier type control device is introduced whereby the athlete then may "inch-by-inch" increase the restraining force as muscles become able to overcome greater forces in the manner that the proverbial strong man who lifts a calf each day trains to lift a full grown cow eventially.

In a preferred embodiment of this improved and precise type of control shown in FIG. 2, the restraining device comprises an electromagnet 11 with a retained magnetic member 23 coupled to the athlete by an intermediate muscular operated linkage attached to the cord 19. The restraining force adjustment device is an electrical current control rheostat 40 coupled in a current supply line for the electromagnet 11. This variable resistance rheostat may be wound to produce a linear or a vernier control of the current from power supply 41 over a working range of exercise, with results indicated upon meter 42 serving as a gage for the force that is to be initially overcome. Thus, the athlete is provided with a self controlled device permitting the athlete to accurately and reliably index the restraining forces in small increments to tone muscular development in a safe and effective manner without the danger of physical muscle damage that is likely if the magnetic restraining force increments becomes too great.

It is to be recognized that the releasable magnetic member 23, when pulled away from its resident position in direct contact with the magnetic core 44 can act as a projectile and thus should be confined in some manner, schematically indicated by the retention member 45. However, the stopping of the magnetic member 23 cannot interfere with the exercise stroke, such as the boxer's punch, so a releasable clutch mechanism 46 is provided to permit substantially effortless payout of the line 19 coupled to the athlete. One manner in which the clutch may be electronically operated is by means of the impulse detector 47 which senses the release of the magnetic member 23 and accordingly electrically releases the clutch 46 to permit free movement of the cord 19 with the athlete's exercise stroke.

Figure 4:
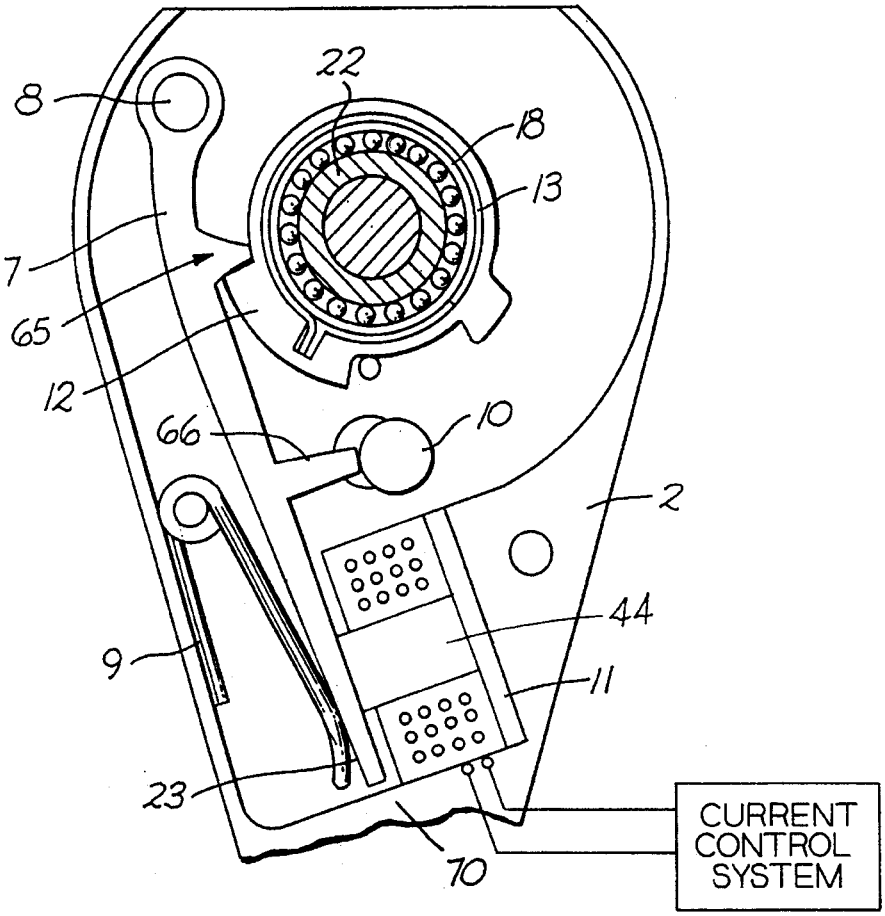
FIGS. 4 and 5 are respectively partial front and back views, partly in section, of the exercising machine of FIG. 3.
Figure 3:
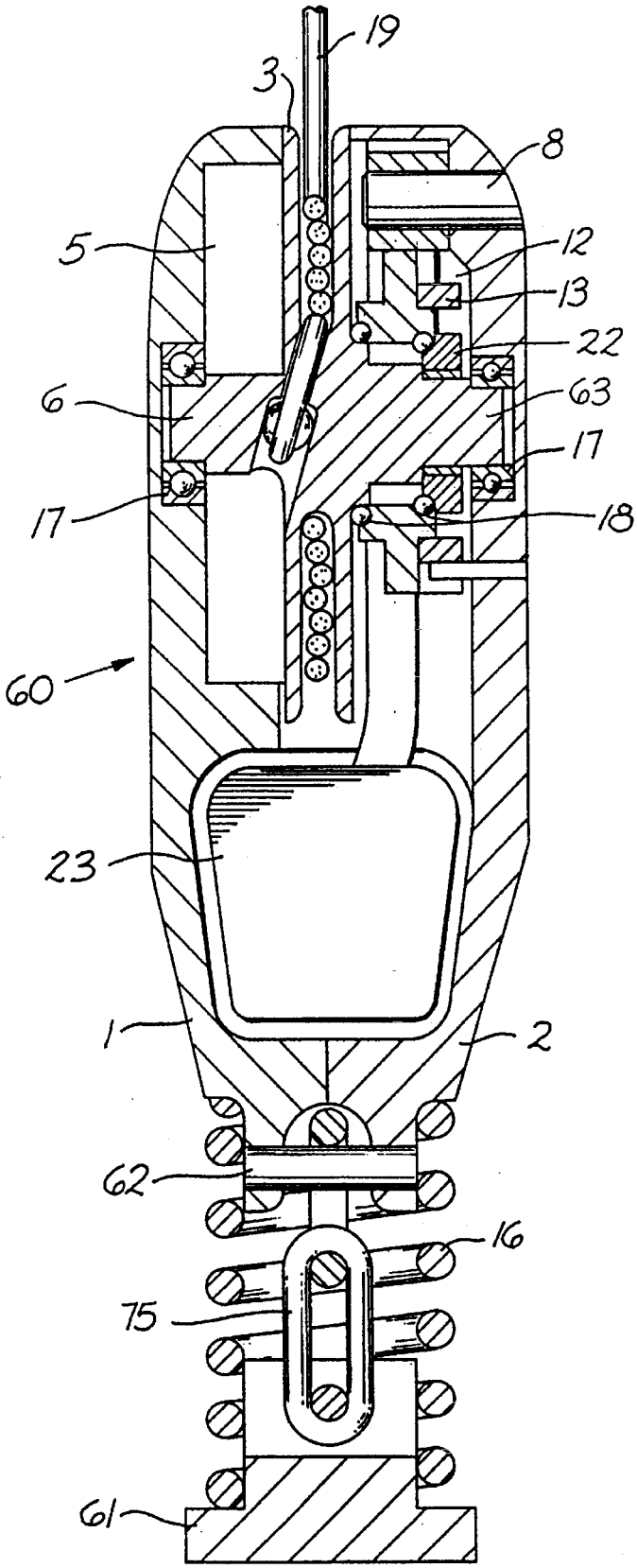
FIG. 3 is a side view, partly in section, of an exercising machine provided in a preferred embodiment of this invention.
Figure 5:
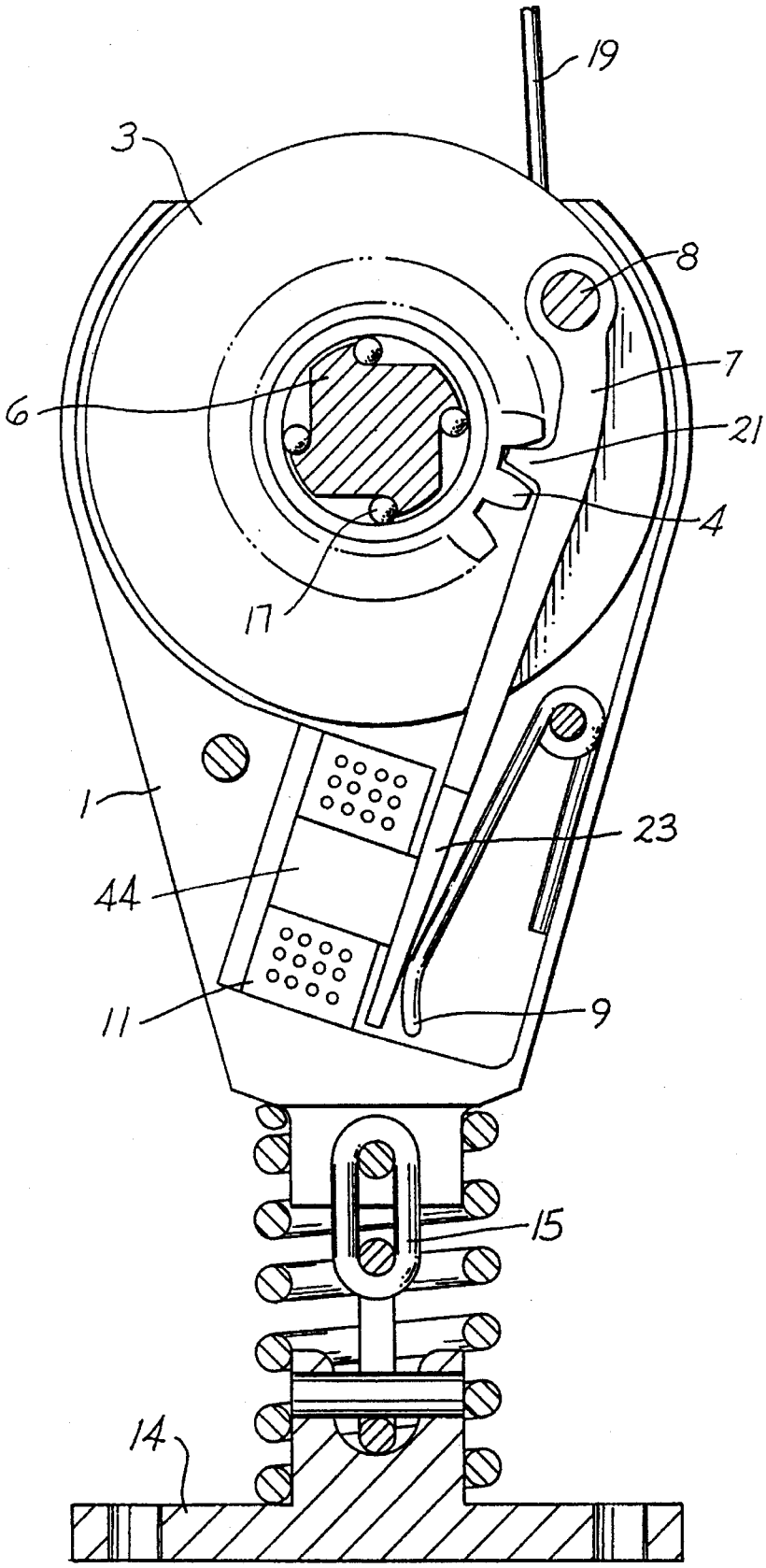

A preferred mechanical embodiment of the invention is illustrated in FIGS. 3 to 5. Thus, in FIG. 3, the main body 60 is flexibly mounted by spring 16 on a base 61 which may be fixed in an operating position on a wall or floor surface. The body 60 may swing with the punch and permit the athlete to move an arm or leg three dimensionally with the cord 19 attached.

The body 60 has two cover pieces 1, 2 held together by band 62 and screws or bolts (not shown). A bobbin 3, rotatable on shaft 63, retains a coiled length of the cord 19 in a normally reset position of the machine before movement of the cord by the athlete is achieved by overcoming the externally generated restraining force, later described. A spiral spring 5 serves to rewind the cord 19 on the bobbin 3 when the athlete returns to a starting position, and has a bias force that does not significantlhy restrain the rotation of the bobbin 3 or the free pay out of the cord 19 after the initial restraining force is released, as achieved by means of the free wheeling clutch 6 and the bearings 17, 18.

The restraining means, as better seen from FIGS. 4 and 5, comprise a lever arm assembly 7 pivotably mounted on rod 8 for engagement of tooth 21 into mating gears on cog wheel 4, which is affixed to bobbin 3 and rotates therewith. The spring 9 returns the locking lever arm means 7 into its normally engaged and locked position following an exercise stroke movement cycle.

The cog gear teeth and lever arm tooth 21 are so designed that they tend to cam the lever arm 7 counterclockwise about pivot rod 8 when and unwinding force (tension) is exerted on the cord 19 by an athlete. The cam plate 12 and corresponding cam rider 65 will retain the lever arm 7 in an unlocked position for rotation of bobbin 3 until the return of the extended cord 19 onto bobbin 3, after which spring 9 pushes lever 7 clockwise into the locking position meshing tooth 21 into the teeth of worm wheel 4.

The counterclockwise force on lever 7 in response to the athlete's body movement attempt must overcome the magnetic field attraction force supplied by the electromagnet 11 and the coacting soft iron magnetic member 23, which serves to provide a predetermined threshold force in restraint against movement of cord 19 by a corresponding movement of the athlete. Note that the core 44 of the electromagnet 11 and the magnetic member 23, which is an integral part of the lever arm 7, are in direct contact without any air gap, and are held securely in that position by electromagnetic force until the above threshold dislodging force caused by pulling on cord 19 releases the magnetic member 23. As the magnetic member is dislodged it encounters the force of spring 9 to absorb the momentum of the magnetic member 23 body, thereby letting the tooth 65 on lever arm 7 settle back upon the outer periphery cam surface 12 while permitting the bobbin 3 to freely unwind the cord 19. During this pay out of cord 19, the tooth 21 of lever arm 7 is thus held outside of the cogs of cog wheel 4.

Thus, since the electromagnetic restraining force, which is established by electrical current through the electromagnet coil 11, is variably adjustable by an appropriate rheostat 40, that rheostat may be fashioned for vernier action over a relative range of current flow to permit restraining force control in small and precise increments. Because there is always direct contact between the magnetic member 23 and the electromagnet core 44 in the ready to use reset position, without any air gap, there is little danger of wear or manufacturing tolerance errors in the setting of the threshold restraining force. Also this control method permits the athlete to be in precise control of the threshold forces so that there is little likelihood of damage to muscles by strain or rupture.

Having therefore improved the state of the art with a safe and effective muscle exercise machine, those novel features descriptive of the spirit and nature of my invention are defined with particularity in the following claims.

I claim:

1. A muscular development machine for an athlete for producing a restraining force which must be overcome by the athlete in the initial portion of an exercise stroke, comprising in combination:

an electromagnetic restraining device comprising an electromagnet member and a retained magnetic member disposed statically in place adjacent each other by magnetic force, a muscular operated linkage coupled between the magnetic member and the athlete operable by the athlete to break the retained magnetic member away from the electromagnet by overcoming a predetermined restraining force exerted by the electromagnet upon said retained magnetic member with an exercise stroke of a body member of the athlete, release means for substantially decoupling the athlete from the restraining device when the magnetic force is overcome by the exercise stroke, and electrically variable current control means for producing an electromagnetic restraining force between said magnetic members of predetermined variable magnitude selectable by said athlete.

2. The machine of claim 1 wherein said linkage further comprises a cord for coupling the magnetic member to the athlete, storage means for storing a length of cord, and a clutch for releasing a length of the cord necessary to complete said exercise stroke from the storage means without substantial movement of the magnetic member and without said substantial impediment to the exercise stroke by the linkage.

3. In a muscular development machine for an athlete having a mechanism exhibiting a restraining force which must be overcome by the athlete in an initial portion of an exercise stroke, the improvement comprising in combination:

electromagnetic retention means for retaining a releasable member statically in place with a variably controlled electromagnetic retention force adjustment means, coupling means between said releasable member and the athlete requiring the athlete to overcome the retention force of the retention means in the initial portion of said exercise stroke, and release means for substantially decoupling the athlete from the retention means when the retention force is overcome to release said releasable member, wherein said retention means further comprises an electromagnet, and the adjustment means further comprises electrically variable current control means for said electromagnet.

4. The improvement defined in claim 3 wherein said release means comprises a clutch actuated when the retention force of the electromagnet is overcome by said exercise stroke.

5. The machine defined in claim 1 wherein the electromagnet member and the retained magnet member are in direct contact without a significant intermediate air gap.

* * * * *